United States Patent [19]

Inverardi et al.

[11] 4,069,653

[45] Jan. 24, 1978

[54] DEVICE FOR LOADING YARN COLLECTION TUBES ONTO THE SPINDLE FACES OF SPINNING MACHINES AND TWISTING FRAMES

[75] Inventors: Giuseppe Inverardi; Natale Chiari, both of Cologne Bresciano (Brescia), Italy

[73] Assignee: Edera Officina Meccanica Tessile S.p.A., Milan, Italy

[21] Appl. No.: 774,603

[22] Filed: Mar. 4, 1977

[30] Foreign Application Priority Data

Mar. 23, 1976 Italy ..... 21496/76

[51] Int. Cl.[2] ..... D01H 9/10

[52] U.S. Cl. ..... 57/53

[58] Field of Search ..... 57/52–54

[56] References Cited

U.S. PATENT DOCUMENTS

| | | | |
|---|---|---|---|
| 3,307,340 | 3/1967 | Nishii et al. | 57/53 |
| 3,328,948 | 7/1967 | DuBuis et al. | 57/53 |
| 3,863,751 | 2/1975 | Vignon | 57/53 X |

*Primary Examiner*—Richard C. Queisser

*Assistant Examiner*—Charles Gorenstein

*Attorney, Agent, or Firm*—Haseltine, Lake & Waters

[57] ABSTRACT

A device for loading yarn collection tubes onto spindle rows of spinning machines and twisting frames. The device comprises a carriage which is moved horizontally at a constant speed along the spindle row. A magazine is disposed on said carriage and contains empty tubes in substantially horizontal position. A first conveyor formed by a succession of cup elements is moved on said carriage along a vertical path and conveys tubes from the magazine into a discharge position where said cup elements are rotated into a vertical position to discharge the tubes therefrom. A second conveyor formed by a succession of vertical seats is moved on said carriage below said first conveyor, at a speed relative to the carriage equal to the relative speed between the carriage and the spindle row, along a horizontal path comprising a first tube collection portion passing below said discharge position of the first conveyor and a second tube delivering portion passing above the spindle row with a direction of movement opposite to that of the carriage so as to be at rest relative to the spindle row.

9 Claims, 12 Drawing Figures

DEVICE FOR LOADING YARN COLLECTION TUBES ONTO THE SPINDLE FACES OF SPINNING MACHINES AND TWISTING FRAMES

This invention relates to a device for loading yarn collection tubes onto the spindle faces of spinning machines and twisting frames.

In spinning machines and twisting frames, each time the yarn has completed its winding on the tubes provided for this purpose on the spindles, the yarn cops must be removed and replaced by empty tubes to be used for further collection of the yarn.

In order to attain operational speed and corresponding high production capacity, the ideal would be to use automatic devices capable of removing the cops and loading the empty tubes continuously along the entire spindle face, without intermediate stoppages in front of individual spindles or groups of spindles which, when added together, assume an importance which cannot be ignored.

While devices are known for continuously removing cops (see for example Italian Pat. application No. 19 124 A/75 filed on Sept. 1, 1975 in the name of the present applicant), the same cannot be said for devices for loading the empty tubes, for which there are at present only a few discontinuous types, such as that described in Italian Pat. No. 704 255.

In view of this, the object of the present invention is to provide an empty tube loading device able to operate continuously along an entire spindle face of a spinning machine or twisting frame.

This object is attained according to the invention by a device comprising a carriage mobile horizontally at a constant speed from one end of the spindle face to the other, and a magazine of inclined base disposed on said carriage and designed to contain the empty tubes in a substantially horizontal position, a first conveyor formed from a succession of cup elements open at their ends, made to move along a vertical path passing in front of the outlet of said magazine to collect said tubes one at a time and convey them into a predetermined discharge position, means associated with said first conveyor to rotate said cup elements into the vertical position to discharge the tubes by free fall when they reach said discharge position, means sensitive to the orientation of the tubes in said cup elements which cause said rotation means to rotate said cup elements into the vertical position in one direction or the other according to the orientation sensed, a second conveyor formed from a succession of vertical seats for housing individual tubes and made to move, at a speed relative to the carriage equal to the relative speed between the carriage and the spindle face, along a horizontal path comprising a first tube collection portion which passes below said discharge position of the first conveyor and a second tube delivery portion passing above the spindle face and provided with motion different from the carriage so that it is at rest relative to the spindle face, and means associated with said second conveyor to retain the tubes in said seats at said first path portion and until the beginning of the second portion and then release them and allow them the fall onto the spindles at said second portion.

It is evident that the most important characteristic of the aforesaid device according to the invention is that the movement of the second conveyor relative to the carriage and the movement of the carriage relative to the spindle face have the same speed but are in different directions over that portion of the path lying above the spindle face. This enables said second conveyor to remain at rest relative to the spindles while it loads the tubes, while enabling the carriage to move at constant speed and hence without interruption from one end of the spindle face to the other. It thus eliminates unproductive intermediate stoppages, and considerably increases the speed of loading the spindle face with consequent increase in productive capacity.

A further important element, characteristic of the device according to the present invention, is the system used for transferring the tubes from the magazine, where they lie in a substantially horizontal position in random orientation, to the second conveyor where they become seated one at a time in the various seats in the second conveyor and with the larger diameter end of their conical structure obliged to face downwards. As stated, this system is based on the combined use of the first conveyor, which takes the tubes one at a time from the magazine and conveys them into a discharge position above the collection portion of the second conveyor, rotation means which rotate the cup elements of the first conveyor and their corresponding tubes into the vertical position, so enabling the tubes to be transferred from the first to the second conveyor by free fall, and the means sensitive to the orientation of the tubes, this being necessary to enable the cup elements of the first conveyor to rotate in one direction or the other according to the orientation detected, and so allow the tubes to fall with their larger diameter end always facing downwards as required.

Finally, the tube reception seats forming the second conveyor preferably consist of tubular elements open at their ends (in particular exactly equal to the cup elements of the first conveyor), in which the tubes are temporarily retained before being allowed to fall onto the spindles, by an underlying plate rigid with the carriage and which is present along the path of the second conveyor from the beginning of the collection portion to the beginning of the delivery portion. As the support plate is missing at this point, the tubes fall freely onto the underlying spindles, relative to which they are at rest because of the described effect of compounding the different directions of movement of the carriage and delivery portion of the second conveyor.

These and further characteristics of the device according to the invention will be more evident from the detailed description given hereinafter of one embodiment shown by way of non-limiting example in the accompanying drawings in which.

Figure 1:
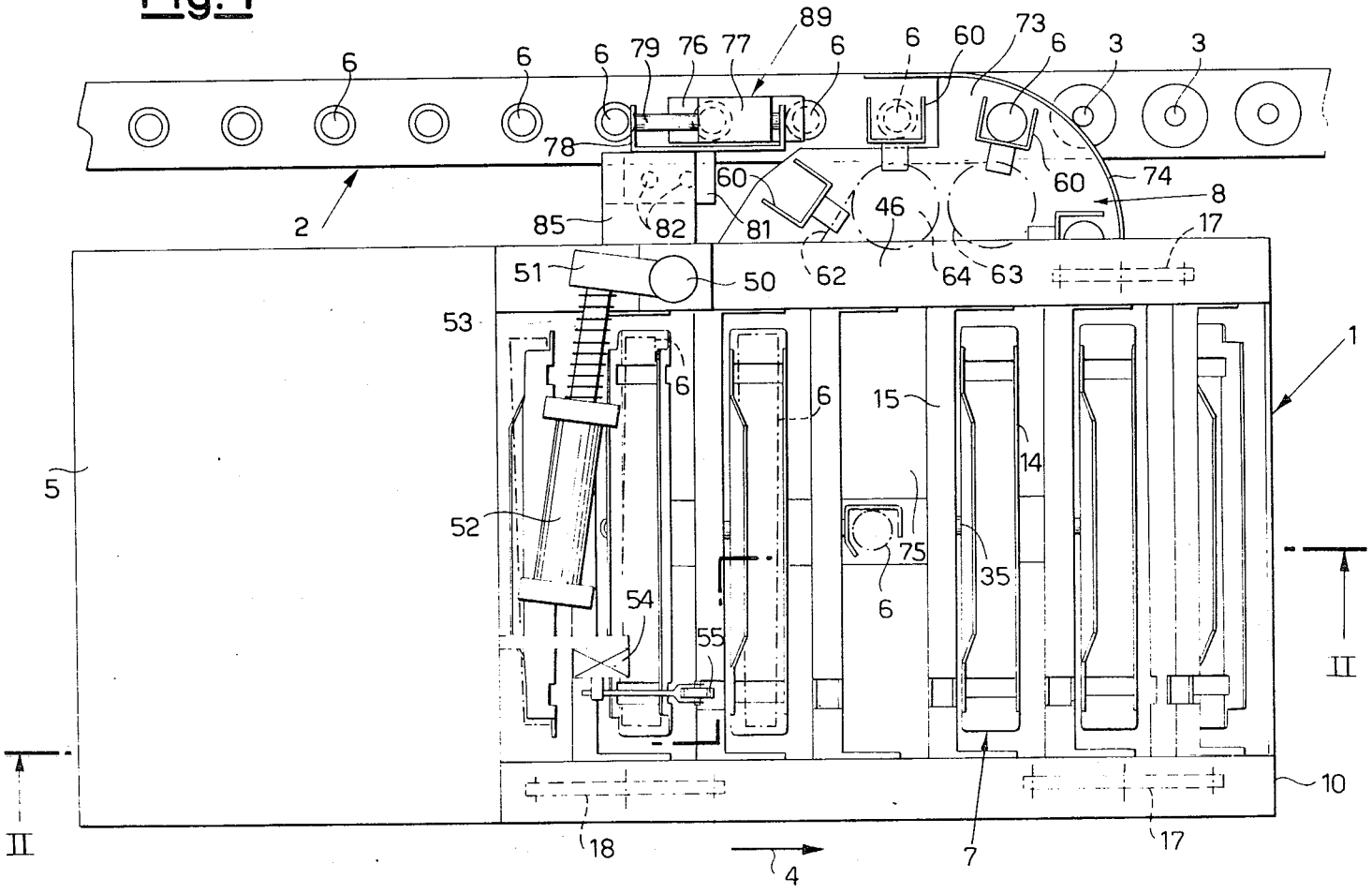
FIG. 1 is a plan view of a device according to the invention while operating along a spindle face of a spinning machine or twisting frame.
Figure 3:
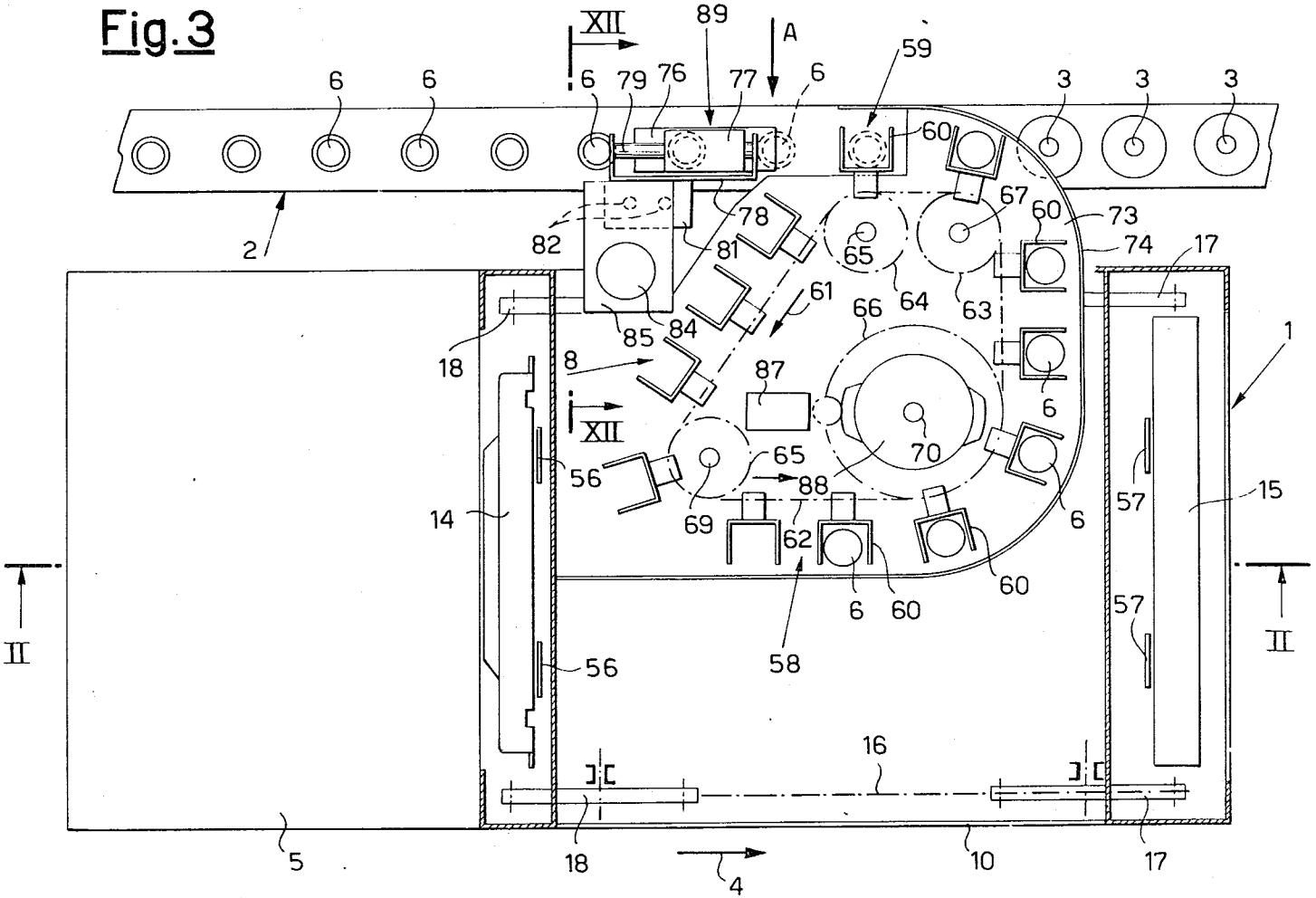
FIG. 3 is a horizontal section through said device on the line III—III of FIG. 2.

The device shown on the drawings and indicated overall by the reference numeral 1 comprises a carriage 10 driven horizontally at constant speed by suitable known means, not shown, along a spindle face 2 of a spinning machine or twisting frame in the direction of the arrow 4 in FIGS. 1 and 3.

On the carriage 1 there are disposed, and hence moved therewith, a magazine 5 with an inclined base for containing the empty tubes 6 (of usual conical shape) lying in a substantially horizontal position with random orientation (FIG. 2), a first elevator conveyor 7 arranged to receive the tubes 6 at the outlet of the magazine 5 and convey them into a raised vertical position (FIG. 2) from which they are discharged by free fall with the required orientation (i.e. with the end of larger diameter facing downwards), and a second conveyor 8 disposed below the discharge position of the conveyor 7 and above the spindle face 2 (FIGS. 2 and 4) and arranged to receive the tubes discharged by the conveyor 7 and feed them to the individual spindles 3 of the spindle face 2 (FIG. 3).

Figure 2:
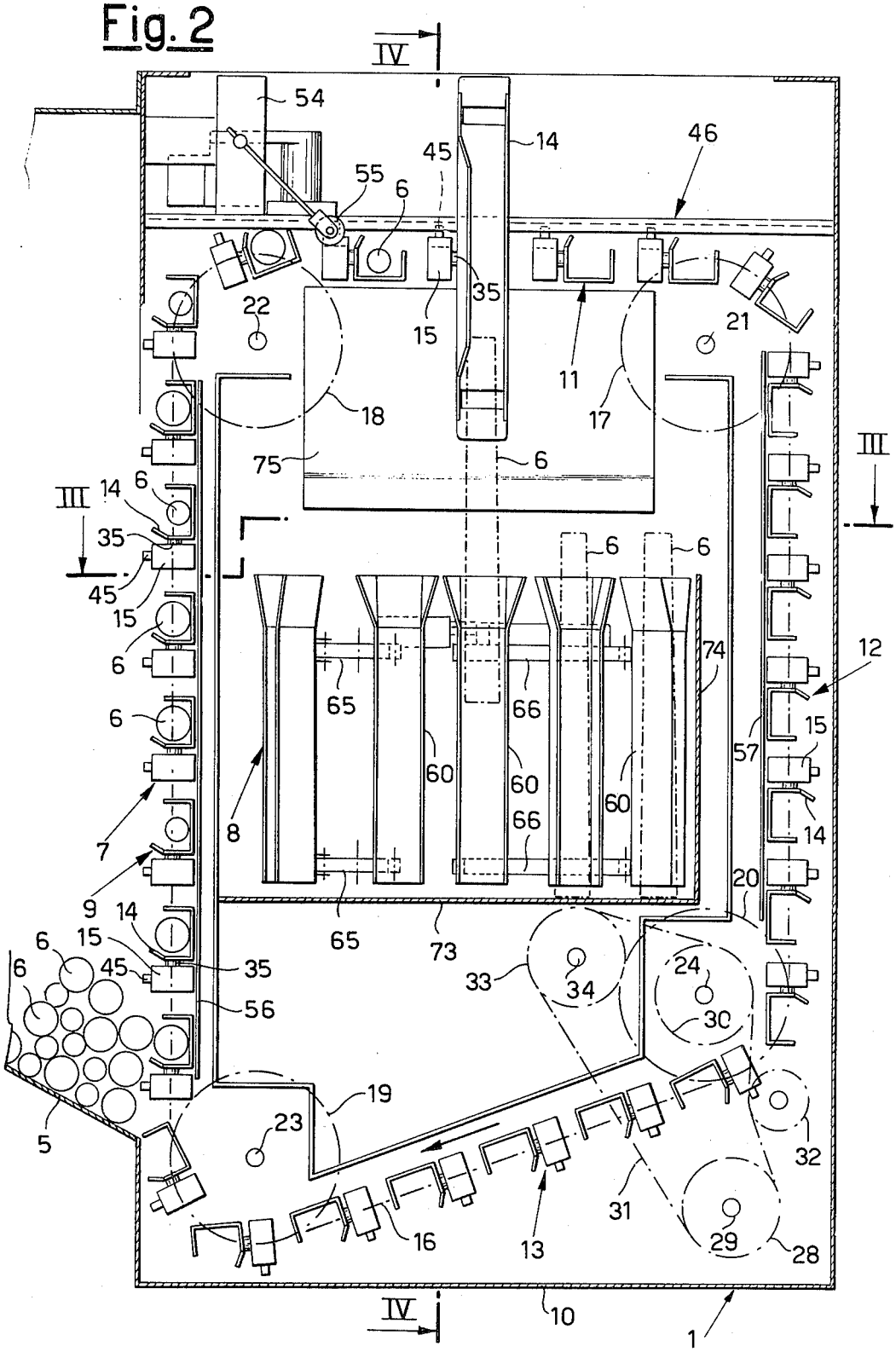
FIG. 2 is a longitudinal elevational section through said device on the lines II—II of FIGS. 1 and 3.

The elevator conveyor 7 extends along a vertical endless path comprising a vertical upward portion 9 directly in front of the outlet of the magazine 5, a horizontal upper portion 11 passing above the second conveyor 8 and two return portions 12 and 13 (FIG. 2). It is formed from a succession of cup elements 14 rotatably connected to respective hollow supports 15, the ends of which are connected to a pair of chains 16 each of which is engaged with four sprocket wheels 17, 18, 19 and 20 (FIG. 2), the first three of which are mounted on respective idle shafts 21, 22 and 23, and the fourth mounted on a driven shaft 24. This latter shaft is driven by a drive motor 25 (FIG. 4) via a transmission system comprising two meshing bevel gears 26 and 27, a gear wheel 28 made rigid with the gear 27 by a spindle 29, a gear wheel 30 mounted on the shaft 24 and a chain 31, which with the aid of a guide gear 32 connects the gear wheels 28 and 30 together and to a further gear wheel 33 mounted on a further driven shaft 34 (FIG. 2), the purpose of which will be clarified hereinafter.

Figure 5:
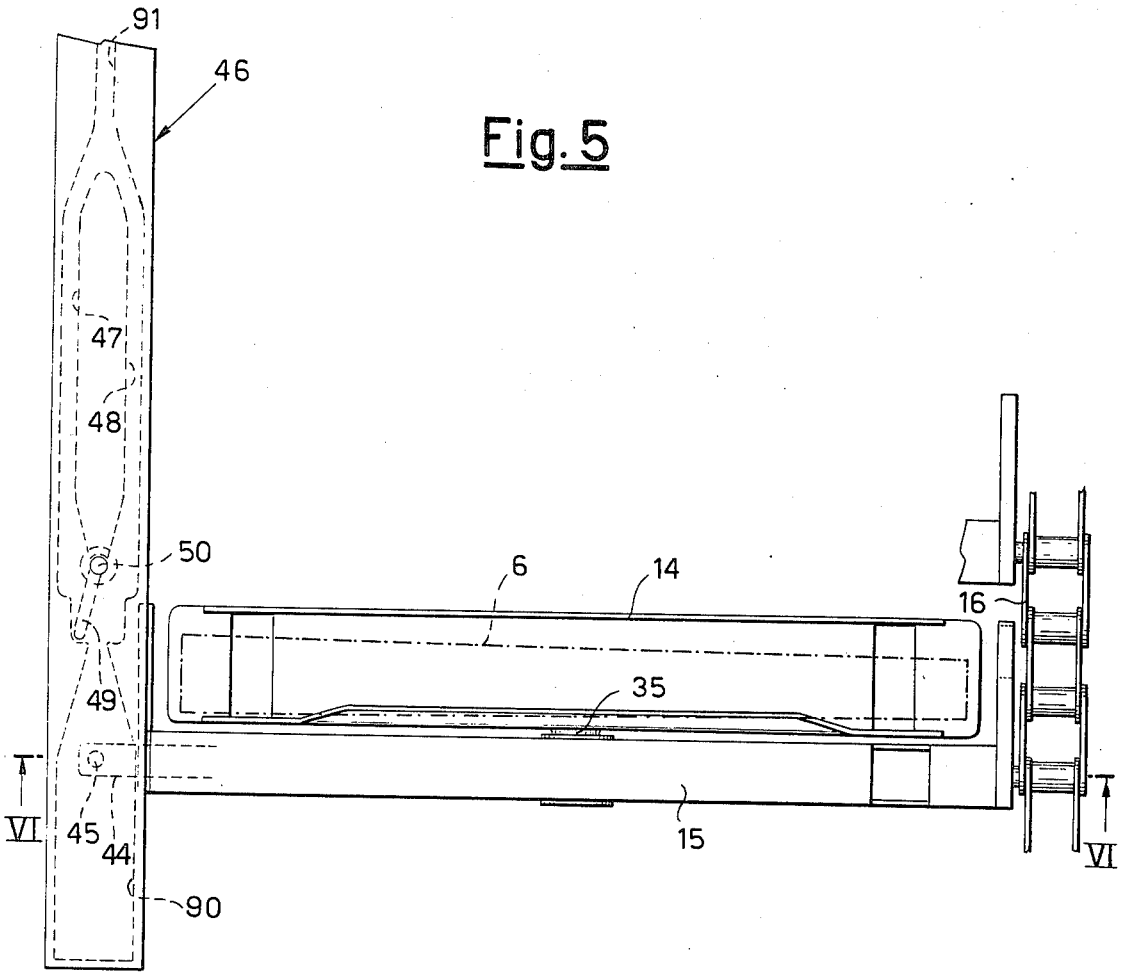
FIG. 5 is an enlarged detailed plan view of the association between the cup elements of the first conveyor of said device and guide means which rotate said cup elements into the vertical position in one direction to the other according to the orientation of the tubes housed therein.
Figure 6:
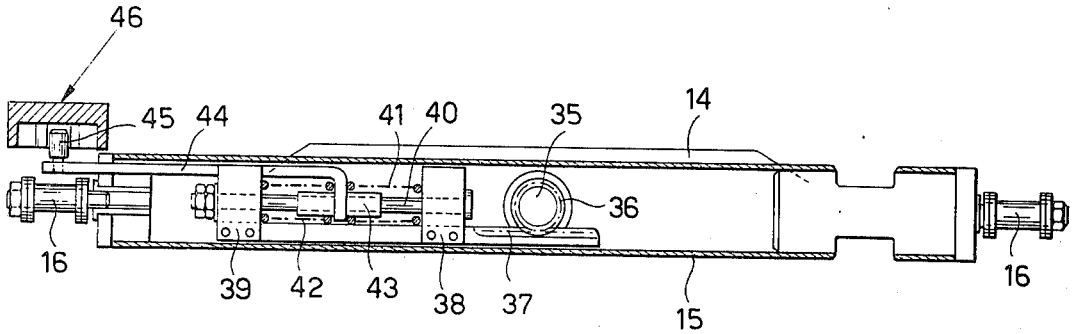
FIG. 6 is a section on the line VI—VI of FIG. 5.

As can be seen from FIGS. 5 and 6, the cup elements 14 are in reality substantially tubular elements open at their ends and provided with a further lateral opening (as can be seen from FIG. 2, they are in fact substantially of C section with the opening facing the magazine 5 along the upward portion 9 and facing upwards along the upper horizontal portion 11), each of which is connected to a spindle 35 rotatably supported by the relative hollow support 15, and on which there is mounted a pinion 36 disposed within said support 15. The pinion 36 engages with a rack 37 rigid with one of two sliding blocks 38 and 39 connected rigidly together by a rod 40. A sleeve 43 is mounted slidably on this latter but is practically blocked by two very rigid springs 41 and 42, the sleeve being rigid with a bracket 44 which slidably passes through the block 39 and carries at its free end a pawl 45. When the hollow support 14 associated with this pawl traverses the upper horizontal portion 11 of the path of the elevator conveyor 7, the pawl engages in an overlying horizontal guide 46 which comprises two parallel paths 47 and 48 which may be alternatively selected by a deviator 49 mounted on a pivot 50. A lever 51 is also mounted on this latter above the guide 46, and is acted upon (FIG. 1) by a pneumatic cylinder 52 and a return spring 53. This cylinder 52 is controlled by a valve 54 provided with a feeler 55 (FIGS. 1 and 2) which rests on one end of each tube 6 which passes under it, to sense whether said end is the end of smaller or greater diameter, and accordingly cause the cylinder 52 to lengthen or shorten. As will be explained hereinafter, this enables the cup elements 14 to be rotated into the vertical position substantially at the centre of the upper horizontal path portion 11, the cup elements being maintained in a horizontal position by fixed uprights 56 and 57 along the upward portion 9 and downward portion 12.

The conveyor 8 extends along a horizontal endless path (FIG. 3) comprising a first portion 58 passing below the upper horizontal portion of the conveyor 7 and in particular below the position in which the cup elements of this latter are mounted vertically, and a second portion 59 passing above one of the spindles 3 of the spindle face 2. It is formed from a succession of vertical seats for housing the tubes, each seat consisting of a tubular element 60 open at its ends and also on the side facing outwards from the conveyor 7. Said tubular elements 60 are connected together and driven in the direction of the arrow 61 (FIG. 3) by a pair of chains 62, each of which (FIGS. 2, 3 and 4) is engaged with four sprocket wheels 63, 64, 65 and 66, the first three of which are mounted on respective idle shafts 67, 68 and 69, and the fourth is mounted on a driven shaft 70. This latter (FIG. 4) is driven by the described drive shaft 34 via two meshing bevel gears 71 and 72. Because of the transmission ratio between the drive motor 25 (which is preferably the drive motor for the carriage 10) and the driven shaft 70 coupled with the transmission ratio determined by the diameter of the sprocket wheels 66, the two chains 62 cause the tubular elements 60 of the conveyor 8 to move at a speed exactly equal to the speed of movement of the carriage 10 along the spindle face 2. Bacause of the fact that the direction of movement of the carriage relative to the spindle face is different from the direction of movement of the portion 59 of the conveyor 8 relative to the carriage, said portion 59 is at rest relative to the underlying spindle, so enabling each individual tubular element 60 to halt above a corresponding spindle 3 while traversing said portion 59.

Figure 4:
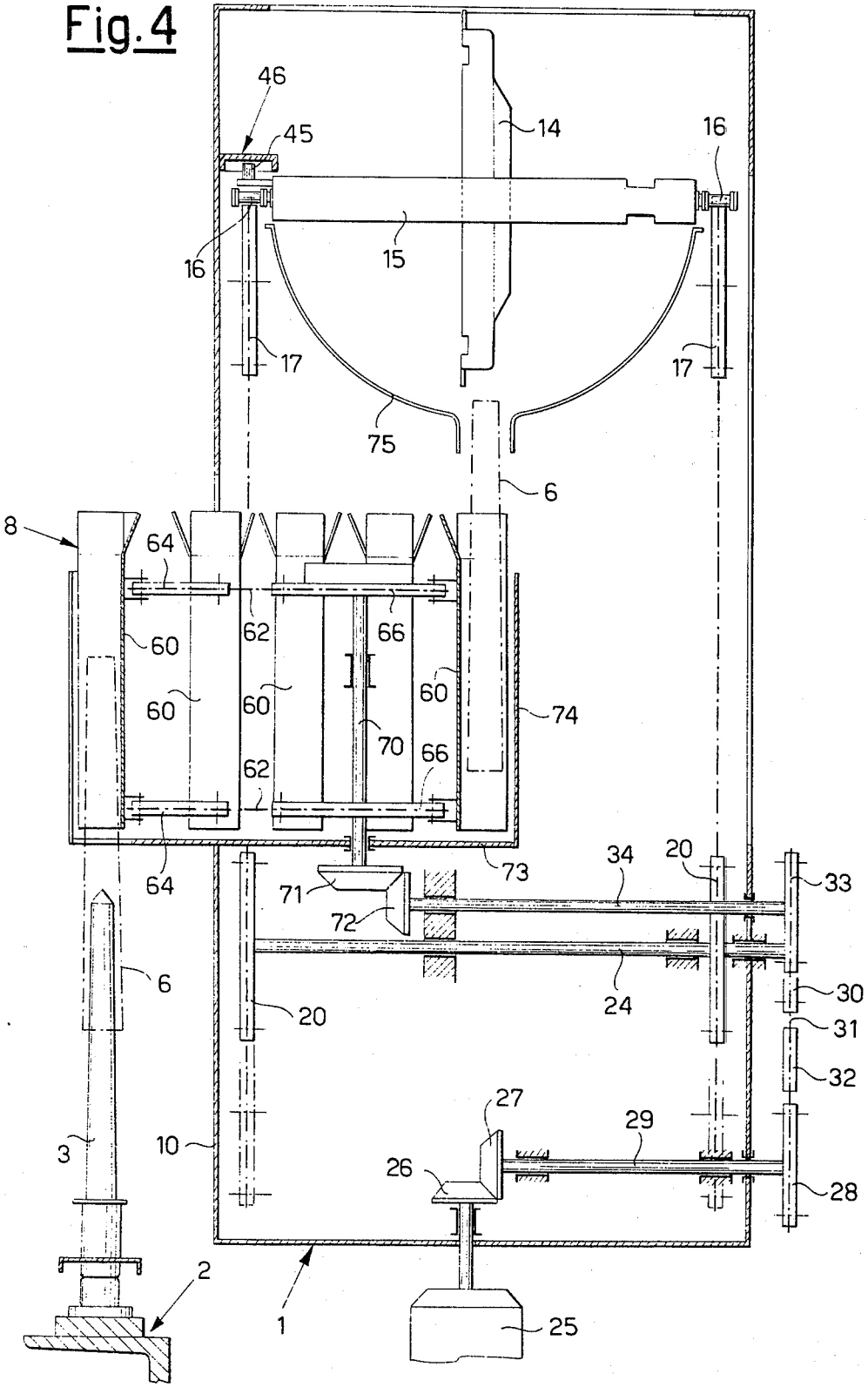
FIG. 4 is an elevational cross-section through said device on the line IV—IV of FIG. 2.

Below part of the path of the conveyor 8 there is disposed a horizontal plate 73 extending from the collection portion 58 to the beginning of the delivery portion 59 and stopping at this latter portion (FIG. 3). It retains the collected tubes 6 in the vertical seats 60 (FIG. 2) and then releases them and allows them to fall when they are positioned exactly above the spindles designed to receive them (FIG. 4). Said plate 73 is associated with a vertical curved wall 74, the purpose of which is to laterally close the vertical seats 60 between the tube collection point and delivery point (FIGS. 2, 3 and 4).

Between the collection portion 58 of the conveyor 8 and the point of discharge of the tubes on the horizontal upper portion 11 of the conveyor 7 there is disposed above the conveyor 8 a funnel element 75, the purpose of which is to ensure that the tube allowed to fall from the overlying cup element 14 properly enters the underlying seat 60.

Finally, the device shown on the drawings comprises mean 89 for mounting the loaded tubes on the spindles, these means comprising, as shown in FIGS. 1, 3, 11 and 12, a mounting plate 76 which can rest on two successive tubes at the same time (FIG. 11), a block 77 rigid with the plate 76 and superimposed on it, a lower support 78 carrying two horizontal bars 79 on which the block 77 is slidably mounted and about which are wound respective springs 80, an upper support 81 with which the lower support 78 is slidably associated by means of two vertical bars 82 about which are wound respective springs 83, and a pneumatic jack 84 with its cylinder fixed to a frame 85 carried by the carriage 10 and its piston fixed to the support 81 by a bracket 86. The pneumatic jack 84 is controlled by a valve 87, with which a cam 88 mounted on the driven shaft 70 co-operates (FIG. 3).

The loading device shown on the drawings is preferably designed for association with the removal device described in the said Italian patent No. 19 124 A/75 of 9.1.1975 (of which the drive motor could possibly be used) for both removing the full cops and reloading the empty tubes in a single pass. The operation of the device is as follows. While the carriage 10 is driven at constant speed along the spindle face 2 in the direction of the arrow 4 in FIGS. 1 and 3, the horizontal conveyor 8 is driven at the same speed (relative to the carriage 10) in the direction of the arrow 61 in FIG. 3. The resultant of these two movements is that one at a time the vertical seats 60 of the conveyor 8 stop above a respective spindle 3 of the spindle face 2. Simultaneously, the elevator conveyor 7, suitably synchronised with the conveyor 8, is driven in the clockwise direction (with reference to FIG. 2), so enabling its cup elements 14, kept in a horizontal position by the uprights 56, to receive the various tubes 6 one at a time with random orientation (through the lateral openings in the cup elements) and bring them to a raised position above the conveyor 8.

Figure 7:
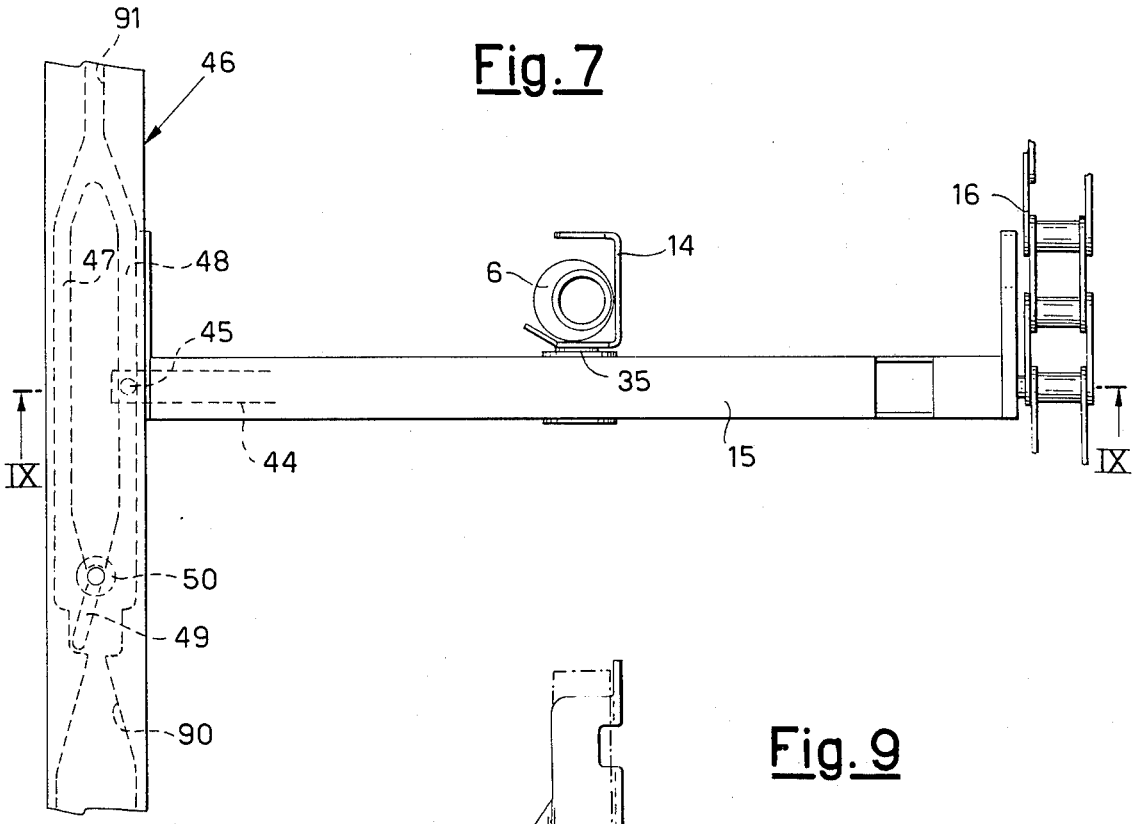
FIGS. 7 and 8 show the same enlarged detail of FIG. 5 in the tube discharge position for opposing orientations of said tube.
Figure 9:
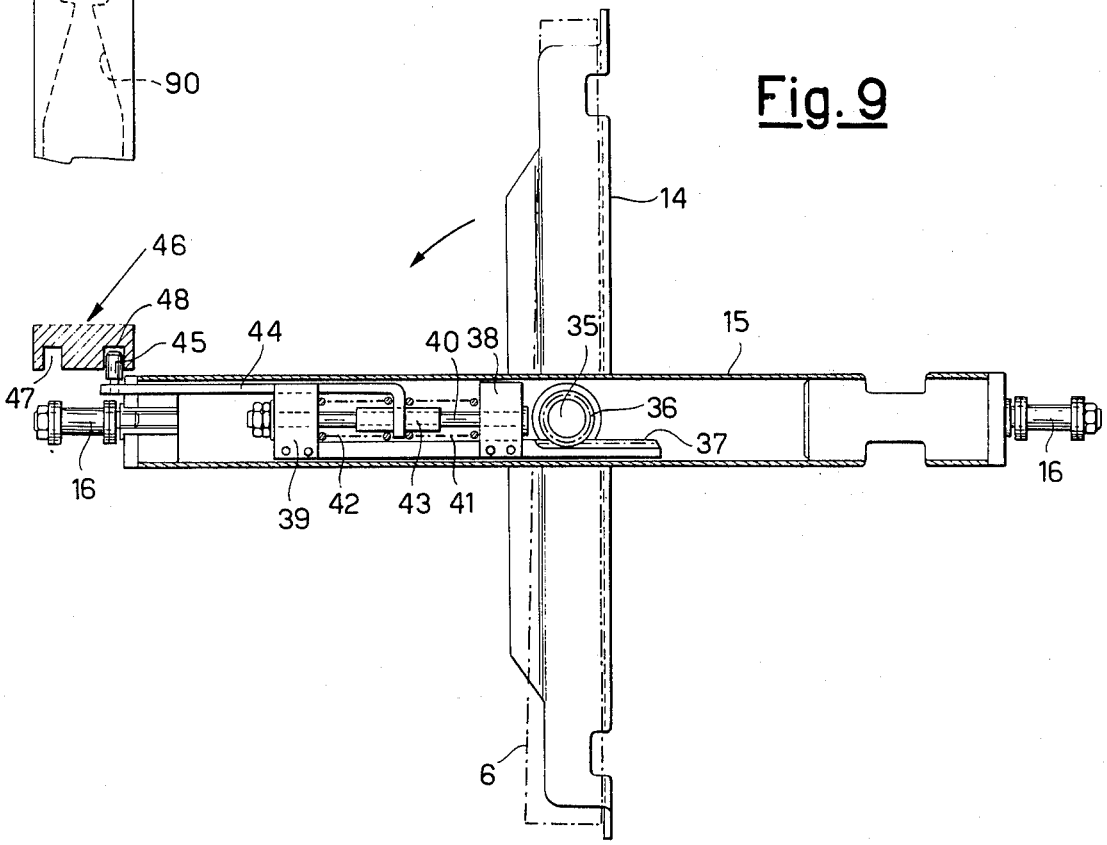
FIG. 9 is a section on the line IX—IX of FIG. 7.
Figure 8:
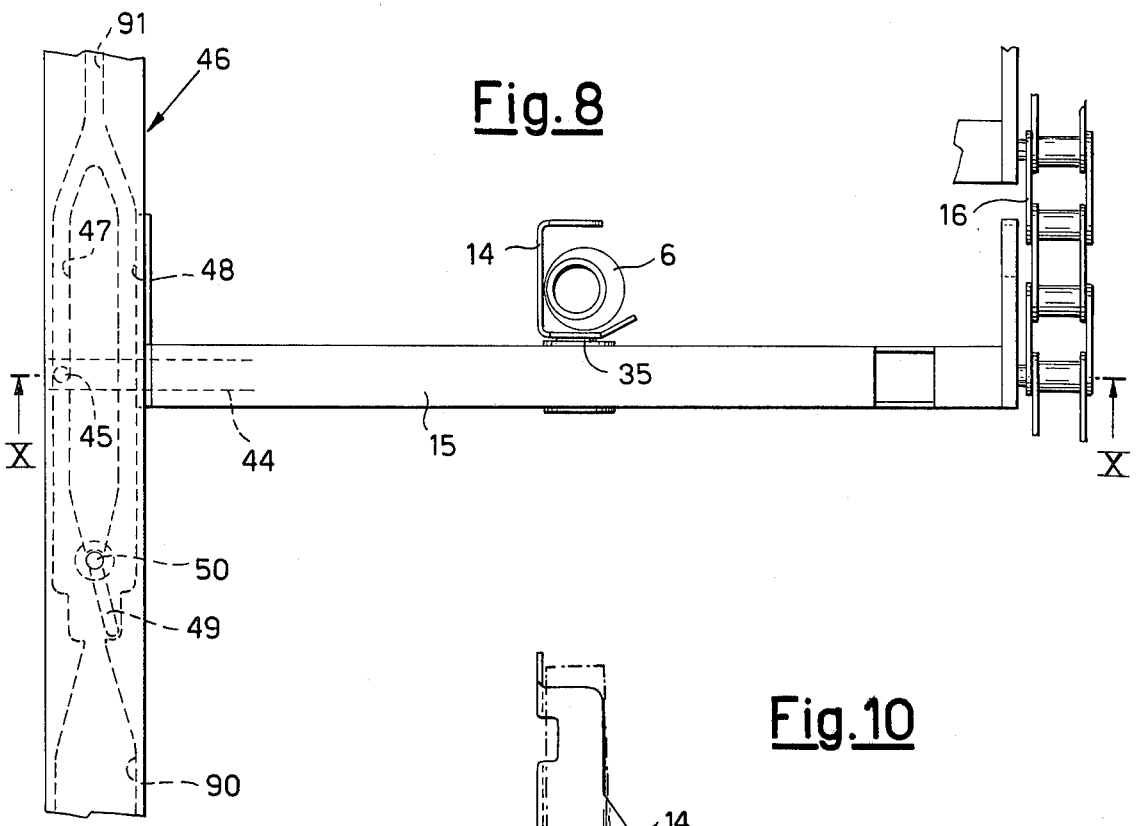
Figure 10:
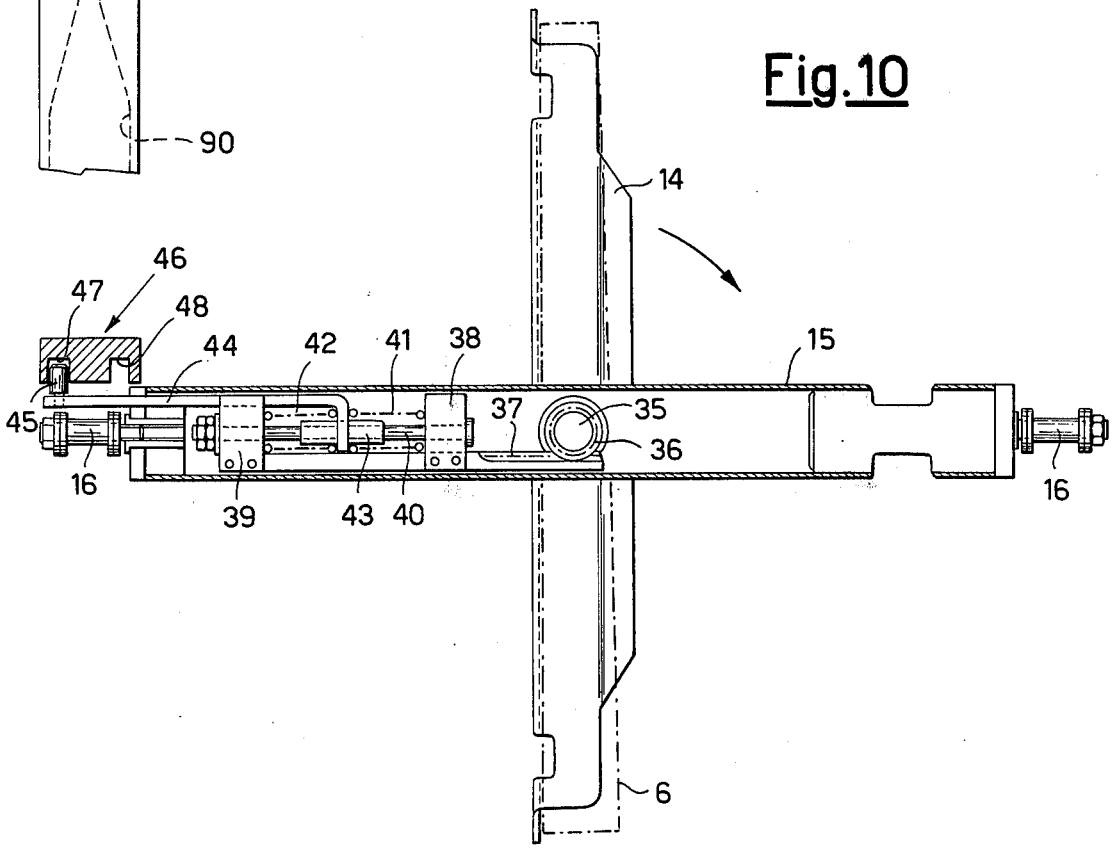
FIG. 10 is a section on the line X—X of FIG. 8.
Figure 12:
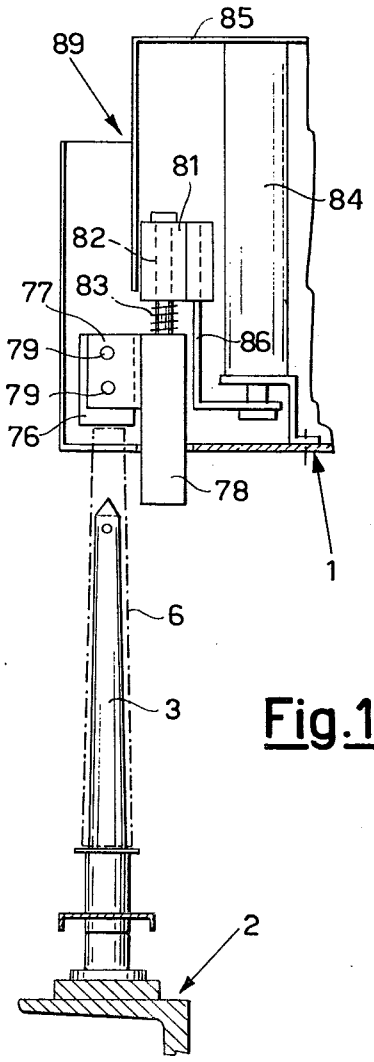
FIG. 12 is a section through the same mounting means on the line XII—XII of FIG. 3.

As each individual cup element 14 reaches the upper horizontal portion 11 of the path of the conveyor 7 and begins to traverse it, the pawl 45 associated with the relative hollow support 15 penetrates into the wide initial portion 90 of the guide 46, keeping in a central position which enables the cup element 14 to remain horizontal as shown in FIGS. 5 and 6. As said cup element progresses, it passes below the feeler 55 which rests on one end of the tube housed in said cup element and controls the valve 54 such that the pneumatic cylinder 52 either lengthens or shortens according to whether a small or large diameter was sensed (indicative of the orientation of the tube), the result of this being either to arrange the deviator 49 in the position of FIG. 7 or in the position of FIG. 8 respectively. As can be seen from FIGS. 9 and 10, in the first case (originating from a tube arrangement as shown in FIG. 5) as the conveyor 7 continues to advance, the pawl 45 is inserted into the passage 48 and thus causes the rack 37 to move towards the right, and this is converted by means of the pinion 36 into an anti-clockwise rotation of the cup element 14 until a vertical position is reached with the tube 6 correctly disposed with its end of greater diameter facing downwards (FIGS. 7 and 9). In the second case (originating from the opposite tube arrangement in the cup element 14) as the conveyor 7 continues to advance, the pawl 45 is inserted into the other parallel passage 47 and thus, in the same manner, causes the rack 37 to move towards the left to result in a clockwise rotation of the cup element 14, thus once again disposing the cup element 14 in a vertical position with the larger diameter end of the tube correctly facing downwards (FIGS. 8 and 10).

In both cases the vertical position is reached as the cup element 14 arrives exactly above a respective vertical seat 60 of the underlying conveyor 8 (FIGS. 2 and 4). The tube housed therein is no longer retained, and thus falls into the underlying seat 60 and rests on the plate 73 present below the conveyor 8 over the collecting portion 58 of its path. While the cup element 14 from which said tube is discharged continues on its course to return to a horizontal position as the two parallel passages 47 and 48 of the guide 46 subsequently converge into a single central passage 91 (FIGS. 5, 7 and 8), the seat 60 which received it when in the collection portion 58 of its path progressively displaces the tube towards the spindle face 2 until it becomes disposed, completely immobile, above the spindle 3 for which it is intended. As the support plate 73 is missing at this point (FIGS. 3 and 4), the tube leaves the seat 60 and falls onto the underlying spindle 3.

Figure 11:
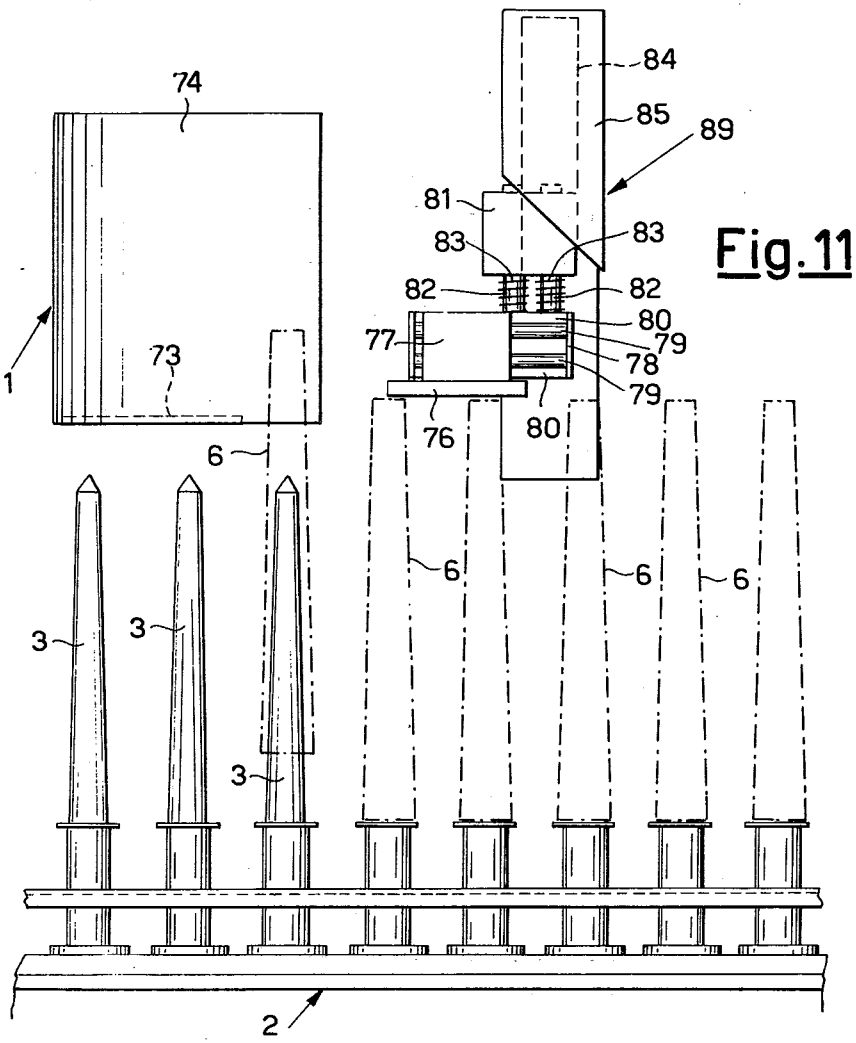
FIG. 11 is an enlarged detailed view along the arrow A of FIG. 3, a tube mounting means forming part of the device shown on the drawings.

After two tubes 6 have been successively delivered and loaded onto successive spindles 3, the cam 88 causes the mounting means 89 to act, its mounting plate 76 being caused to descend by the pneumatic cylinder 84 and yieldably press on the top of the two tubes so that they become completely mounted on the respective spindles (FIG. 11). The pressure exerted on the tubes is made yieldable by the slidable coupling between the supports 78 and 81 in combination with the springs 83. In contrast, the purpose of the slidable coupling between the block 77 and support 78 plus the action of the springs 80 is to compensate for the horizontal relative movement between the carriage and spindle face, so allowing the plate 76 to remain at rest relative to the pressed tubes, while the carriage moves.

The cycle is repeated as described for all the tubes necessary for loading the entire spindle face. While the carriage moves at constant speed, the tubes are taken one at a time from the magazine 5, raised above the conveyor 8, disposed vertically with the desired orientation, allowed to fall into the underlying conveyor 8, collected from here and allowed to fall onto the spindles, and finally pressed over them by the mounting plate 76.

What we claim is:

1. Device for loading yarn collection tubes onto the spindle faces of spinning machines and twisting frames, comprising a carriage mobile horizontally at a constant speed from one end of the spindle face to the other, and a magazine having an inclined base disposed on said carriage and designed to contain the empty tubes in a substantially horizontal position, a first conveyor formed from a succession of cup elements open at their ends, made to move along a vertical path passing in front of the outlet of said magazine to collect said tubes one at a time and convey them into a predetermined discharge position, means associated with said first conveyor to rotate said cup elements into the vertical position to discharge the tubes by free fall when they reach said discharge position, means sensitive to the orientation of the tubes in said cup elements which cause said rotation means to rotate said cup elements into the vertical position in one direction or the other according to the orientation sensed, a second conveyor formed from a succession of vertical seats for housing individual tubes and made to move, at a speed relative to the carriage equal to the relative speed between the carriage and the spindle face, along a horizontal path, said second conveyor comprising a first tube collection portion which passes below said discharge position of the first conveyor and a second tube delivery position passing above the spindle face and provided with motion in a direction opposite to that of the carriage so that it is at rest relative to the spindle face, and means associated with said second conveyor to retain the tubes in said seats at said first path portion and until the beginning of the second portion and then release them and allow them to fall onto the spindles at said second portion.

2. A device as claimed in claim 1, wherein said first conveyor comprises within its part an ascent portion passing in front of the magazine outlet for collecting and raising the tubes one at a time, and a successive upper horizontal portion overlying said collection portion of the second conveyor and including said discharge position.

3. A device as claimed in claim 2, wherein each of said cup elements is formed from a substantially tubular element open at its ends and provided with a longitudinal side opening facing outwards for collecting the tube.

4. A device as claimed in claim 2, wherein each of said cup elements is rotatably coupled to a respective hollow support comprising a rack and pinion coupling, the pinion being mounted on a shaft for rotating the cup element, and the rack being slidable along said hollow support between a central position thereof, in which the cup element is disposed horizontally, and one or another of two lateral displaced positions in which the cup element is disposed vertically by rotating in one direction or another respectively, guide means disposed in proximity to said first conveyor said rack being associated with a pawl which, while the cup element traverses said horizontal upper portion of the path of the first conveyor, becomes inserted in and runs along said guide means.

5. A device as claimed in claim 4, wherein said guide means comprises two parallel passages for receiving said pawl under the urging of deviator means acting in concert with said sensitive means.

6. A device as claimed in claim 5, wherein said sensitive means consist of a feeler arranged to rest on one end of the tube housed in each individual cup element, said feeler being associated with a control valve for a hydraulic drive cylinder for said deviator means so as to cause this latter to move into the selection position for one or the other of said parallel passages of said guide means, according to the detected diameter of said end of the tube.

7. A device as claimed in claim 1, wherein said vertical seats of the second conveyor are formed of respective tubular elements open at their ends and in which the tubes are retained between the beginning of said collection portion and the beginning of said delivery portion by resting on an underlying support plate disposed in proximity thereto and which comprises an opening at said delivery portion.

8. A device as claimed in claim 1, wherein tube mounting means are disposed on said carriage to lie above the spindles as they become loaded, said means being actuated periodically in order to mount the loaded tubes completely over the spindles.

9. A device as claimed in claim 8, wherein said mounting means comprise a mounting plate coupled to a hydraulic cylinder arranged to cause the plate to descend onto the top of the loaded tubes to exert a pressure thereon, means mounting the plate for allowing the pressure on said tubes to yield, and compensating means for compensating the relative horizontal movement between the carriage and spindle face.

* * * * *